United States Patent [19]

Dumbeck et al.

[11] Patent Number: 4,586,146

[45] Date of Patent: Apr. 29, 1986

[54] GRINDING MILL CONTROL SYSTEM

[75] Inventors: Robert F. Dumbeck, Elgin; Phillip W. Welch, Houston, both of Tex.

[73] Assignee: W. R. Grace & Co., Cambridge, Mass.

[21] Appl. No.: 521,252

[22] Filed: Aug. 8, 1983

Related U.S. Application Data

[63] Continuation-in-part of Ser. No. 238,710, Feb. 27, 1981, Pat. No. 4,404,640.

[51] Int. Cl.[4] ..... B02C 25/00

[52] U.S. Cl. ..... 364/551; 364/474; 241/33

[58] Field of Search ..... 364/551, 474, 571, 468, 364/469, 475; 241/24, 26, 30, 33, 34, 35

[56] References Cited

U.S. PATENT DOCUMENTS

| | | | |
|---|---|---|---|
| 2,766,941 | 10/1956 | Weston . | |
| 3,783,252 | 1/1974 | Putman . | |
| 3,839,628 | 10/1974 | Higgins et al. | 324/71 X |
| 3,860,804 | 1/1975 | Rutman . | |
| 3,904,857 | 9/1975 | Sandblom | 73/133 R X |
| 3,988,578 | 10/1976 | Weber | 318/39 X |
| 4,026,479 | 5/1977 | Bradburn et al. . | |
| 4,210,290 | 7/1980 | Andersson et al. . | |
| 4,212,429 | 7/1980 | Cuvelier et al. . | |
| 4,281,800 | 8/1981 | Flavel . | |
| 4,294,412 | 10/1981 | Bohlin et al. | 241/30 |
| 4,404,640 | 9/1983 | Dumbeck et al. | 364/551 |

FOREIGN PATENT DOCUMENTS

| | | |
|---|---|---|
| 223634 | 2/1958 | Australia . |
| 249066 | 5/1963 | Australia . |
| 576472 | 4/1946 | United Kingdom . |
| 630980 | 10/1949 | United Kingdom . |
| 854782 | 11/1960 | United Kingdom . |
| 949792 | 2/1964 | United Kingdom . |
| 1291691 | 12/1970 | United Kingdom . |
| 1299597 | 12/1972 | United Kingdom . |
| 1328939 | 9/1973 | United Kingdom . |
| 1351387 | 4/1974 | United Kingdom . |
| 1401113 | 7/1975 | United Kingdom . |

*Primary Examiner*—Edward J. Wise

*Attorney, Agent, or Firm*—Laurence R. Brown

[57] ABSTRACT

Computerized control of a grinding mill complex to establish a predetermined optomized operating setpoint condition in the presence of chemical additive grinding aids responds to a plurality of input signals representative of mill operating characteristics and controls a plurality of input feed materials for establishing the setpoint condition. Provision is made for accelerating correction when deviations from optimum are large. A prioritized selection of input signals serves to first control mill conditions that could damage elevator motors, or the like. Control signals are derived as a function of error deviations for more effective control and are normalized for lag time. The system combines an arithmetic computer with a multiplexing computer that scans and organizes correction control signals and provides for communication with external computers.

20 Claims, 5 Drawing Figures

GRINDING MILL CONTROL SYSTEM

This invention is a continuation-in-part of our copending application Ser. No. 238,710 filed Feb. 27, 1981 for Grinding Mill Monitoring Instrumentation, now U.S. Pat. No. 4,404,640 issued Sept. 13, 1983, and to whatever extent necessary the disclosure of that application is incorporated herein by reference.

TECHNICAL FIELD

This invention relates to grinding mills, particularly of the ball mill type and associated mill complex system elements, and more particularly it relates to electronic instrumentation for sensing mill complex parameters, such as the flow of materials therein, and deriving control information for conforming operation of the mill in accordance with a predetermined operating plan.

BACKGROUND ART

Automatic grinding mill controls responsive to mill conditions to control the grinding process are known in the art. Exemplary of general mill controls are U.S. Pat. No. 4,026,479 issued to R. G. Bradburn et al., May 31, 1977; U.S. Pat. No. 4,210,290 issued to R. E. P. Andersson et al., July 1, 1980; and U.S. Pat. No. 4,212,429 issued to J. P. Cuvelier et al., July 15, 1980.

The control of a mill to conform to a desired reference condition is taught in U.S. Pat. No. 2,766,941 issued to D. Weston, Oct. 16, 1956. Calculations based on conditions found in the mill complex for controlling the flow of materials therein are known for example in U.S. Pat. No. 4,281,800 issued to M. D. Flavel, Aug. 4, 1981 and U.S. Pat. No. 3,783,252 issued to R. E. J. Putman on Jan. 1, 1974, which take into account a variable grindability of the input materials. In U.S. Pat. No. 3,860,804 issued to R. E. Rutman, Jan. 14, 1975 is shown a computer to control the grinding process in accordance with a control algorithm to improve the flow rate of the material being ground. British Patent Specification No. 854782, published Nov. 23, 1960 derives a control signal as a function of the dynamic mill increasing or decreasing power variation to keep power in the mill at a maximum.

The beforementioned parent application for the first time introduced computer controlled automatic monitoring systems taking into account the effect of chemical additives used for improvement of grinding efficiency in ball mill type grinding system complexes. The effect of chemicals on the efficiency and cost of grinding is significant and thus it becomes necessary for any automatic grinding control systems to have the capacity for control of the flow of chemicals as well as basic raw materials to be ground. All the hereinbefore cited prior art systems have the common deficiency that they control only with one variable control of the primary material flow path, and the use of chemical additive grinding aids can completely mask and overcome the effect of that type of automatic control.

Accordingly, it becomes necessary to resolve the problem of automatically controlling the flow of materials in a grinding system complex for meeting predetermined objectives such as maximum throughput volume or maximum grinding efficiency in the presence of various kinds and quantities of chemical additives. The additional criterion of controlling for the most efficient use of the optimum flow of chemical additives, is not addressed in the prior art, and presents a serious economic problem in view of the relatively high cost of the chemical additives over the usual materials being ground.

Also other control problems encountered in the grinding process are not addressed in the prior art, particularly relating to the control of the grinding process in the presence of chemical additives, such as the following:

(a) the ability to derive meaningful true change of flow signal from the grinding process that will vary significantly enough and not be masked by a high level of throughput volume, (b) the ability to control interactions between different flow rates in different parts of the grinding system complex and between different flow rates for different grinding process material constituents, (c) significantly long times are taken to correct large deviations from flow rates such as occurred at startup or upon changes in grinding materials, etc., and (d) the lack of system operating data or appropriate readily available operational data permitting diagnosis of the system operations by computer analysis to determine operating characteristics and feasible modes of system improvement.

It is therefore an objective of the present invention to resolve the foregoing problems. Other features, objectives and advantages of the invention will be found throughout the following description, drawing and claims.

DISCLOSURE OF THE INVENTION

This invention provides electronic data processing capability for processing a plurality of input variables and their interrelationships in a grinding mill complex. Also the control criteria for a plurality of output control functions can be handled to control for example independently the flow of clinker to be ground and the grinding aid chemicals. Thus, variations in flow of materials in the grinding mill complex will be analyzed to develop correction signals for maintaining the mill complex operating conditions at a predetermined optimum operating point. For example, the grinding mill horsepower represents flow of materials through the grinder as one input and the motor current in an elevator in the mill complex can indicate the flow rate of the materials as two critical input signals for effectuating control of the mill to establish a predetermined optimum operating coordinate position of a specified mill horsepower and bulk density.

Error signals as departures from the selected operation setpoint coordinate are thus determinable and are used in various modes, such as to improve control correction signals and to expedite fast correction in a mode responsive to the magnitude of error signals. Also a comparison of the two input signals to see which departs a greater distance from the setpoint provides a basis for a priority choice of the preferred input condition to correct. Such signal selection prevents equipment damage and maintains low energy expenditure.

A single channel main arithmetic computer unit is coupled with a multiplex scanning computer unit for achieving multiple input, multiple output capabilities. Thus, an optimum flow of several chemical grinding aids may be achieved together with the materials to be ground, all referenced to a predetermined setpoint condition. Otherwise high cost chemicals would be wasted because of the interdependence upon flow rates, product density, etc. This permits effective optimization of chemical additive flow rates.

The system effectively controls over a wide error range by means of detecting relatively small signal variations of mill horsepower superimposed upon large magnitudes of horsepower without masking in the very high background magnitude. Thus, variations of a few amperes of mill motor current superimposed upon a very large ampere current flow into the motor are isolated by a current transformer for sensing only the signal variation component providing sensitive control of this critical input parameter. Particular protection is given to both elevator and mill operating motors to protect the system and prevent damaging overloads which could occur in prior systems without multiplexed controls of multiple variables.

Furthermore, for analysis of the system and development of setpoint conditions for different chemicals and local plant conditions, provision is made for storing operating history data for readout when desired into a local analyzing computer.

Other objects, features and advantages of the invention will be found throughout the following description, the drawings and the claims.

THE PREFERRED EMBODIMENT

Figure 1:
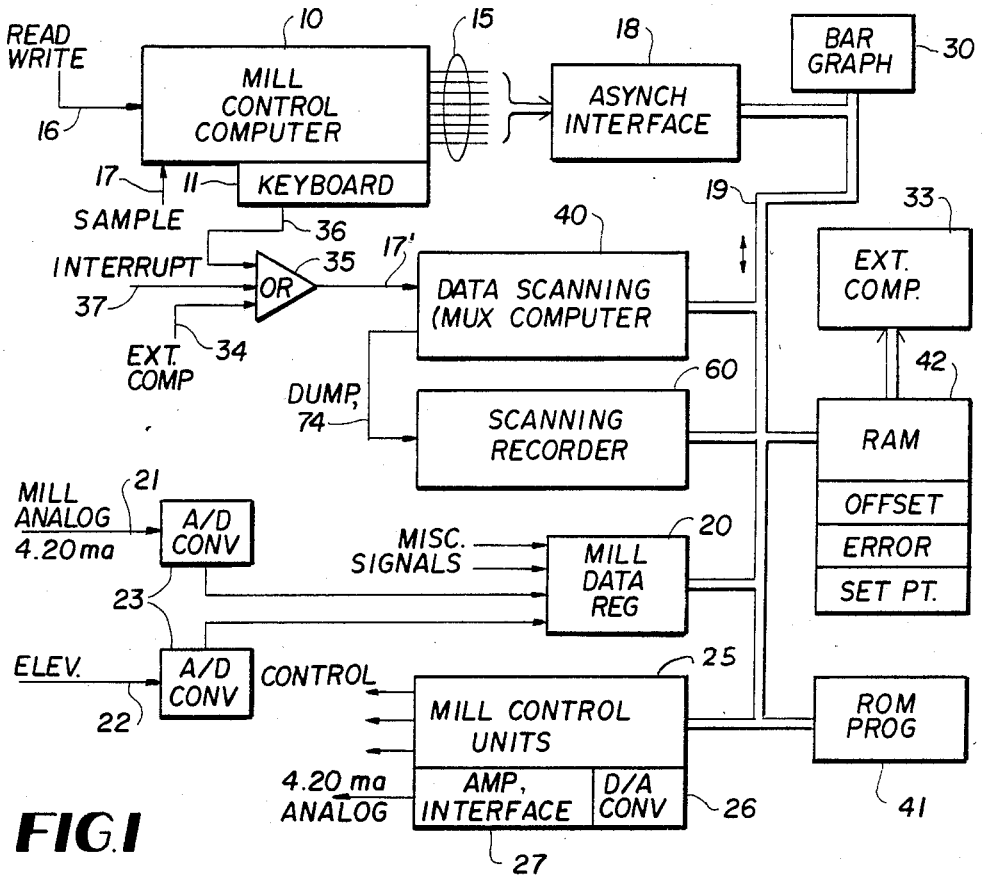
FIG. 1 is a block diagram showing interconnections of the various units of a computerized system for controlling grinding mill operations to achieve a predetermined operation condition.

As may be seen from the block system diagram of FIG. 1, several reference characters are commonly used from the parent application above-identified for purpose of ready comparison. The mill control computer 10, thus in the aforesaid application, has a read-write control lead 16, a sample or interrupt control 17 and a communication bus 15 for coded data, which links with a scanning recorder 60 for storage of historical mill operation data. In that application the mill computer primarily made calculations for display and monitor purposes, thus providing data for semi-automatic control. That is, unskilled operators could read automatically computed visual displays showing how to make corrections in mill material flow rates, and in particular could optimize control of the effect of chemical additives, etc. However, this present invention is directed toward expansion of that computer as used therein for effectuating control automatically and for expanding the system to solve the problems in the art hereinbefore discussed.

The mill control computer 10 is basically a micro computer such as "Motorola 6800" series with an arithmetic chip from National SCM 57000 series. Thus, the mill control computer 10 processes flow control data and produces output control signals. To input such data as desired, including the operational setpoint conditions, the computer keyboard 11 may be used. The asynchronous interface unit 18, typically a "Motorola 6850P" unit provides access between the base arithmetic computer 10 and the rest of the control system along the bus or cable link 19 interconnecting the various units.

In accordance with the present invention, a plurality of mill complex data signals representative of flow of materials in the complex may be handled by way of mill data interface register 20. "Motorola" interface adaptor units "MC6821" act as input parts for sampling four signals. The two critical signals relating to the mill and elevator taken from transducers in the form of four to twenty ma analog signals are represented at two of the input leads 21, 22, respectively. These are processed through span and zero normalizing control circuits into an analog to digital converter unit 23 such as the "National Semiconductor" Model "AD0804". In such case an analog conversion from the four to twenty ma signal to one to five volts couples the leads 22, 23 for full range output to provide output digital data in hexa-decimal digital form (0–255) for compatible use in the system and register 20. Thus, four analog signals are available in the mill data register from four input signals representative of mill operating conditions for appropriate scanning and sampling as will hereinafter be described.

Similarly four output signals may be stored in the mill control register units 25. Each register unit provides a digital to analog converter 26, typically "National Semiconductor" DAC 1002 units providing a one to five volt analog signal, converted by amplifier buffer interface 27 to produce a four to twenty ma control signal for analog control of selected material flow pumps, etc., in the mill complex. Thus, the control signals are updated as the computer system samples and updates such as every second, or the like, to direct the mill toward an optimized operating condition.

The output bar graph unit 30 gives a visual comparison of the input mill status output control relationships at all times, and is typically two four bar sixty four segment "AD622" Models manufactured by AND Corporation, Burlingame, Ca., which are directly under control of the computer 40 and computer bus 19.

The scanning recorder 60 accumulates operational data on a time sampled basis, including any pertinent data in the mill input or control registers 20, 25, as passed through interface 18 and cable 15 to the computer 10 which loads the recorder as set forth in the parent application. The recorder may be controlled by means of the computer keyboard 11 or an external computer signal (34) for transfer into a local external computer 33 at the mill site by way of a buffer random access memory unit 42. Thus, all the operating data may be analyzed for deriving preferred setpoints or improved controls, etc. The external computer 33 may trigger a transfer on a non-maskable interrupt line 34 via OR circuit 35 into the multiplex computer 40, which may also be operated from the mill control computer 10 automatically or by keyboard 11 along interrupt lead 36. Other interrupts may be transmitted via lead 37 to cause the multiplex computer 40 to scan and process the data from the units shown in FIG. 1.

The multiplexing computer 40 may be a "Motorola MC6802" microprocessor controlled for scanning the input and output registers 20, 25, and other system data as programmed by means of a program in the external read only program memory unit 41. The random access memory unit 42 may hold other variable data or constants related to the particular control procedure in use, such as offset data for adjustment or normalization of analog data ranges, for current or past error signals used by this invention in the development of control signals and for storing the setpoint, which varies from plant to plant because of differences in systems, or materials to be ground, or chemicals added, etc. Thus, the control system interconnected as shown in FIG. 1 permits the multiplexing of a plurality of input and output signals into the arithmetic computation system of mill control computer 10, under control of multiplexing computer 40.

Figure 2:
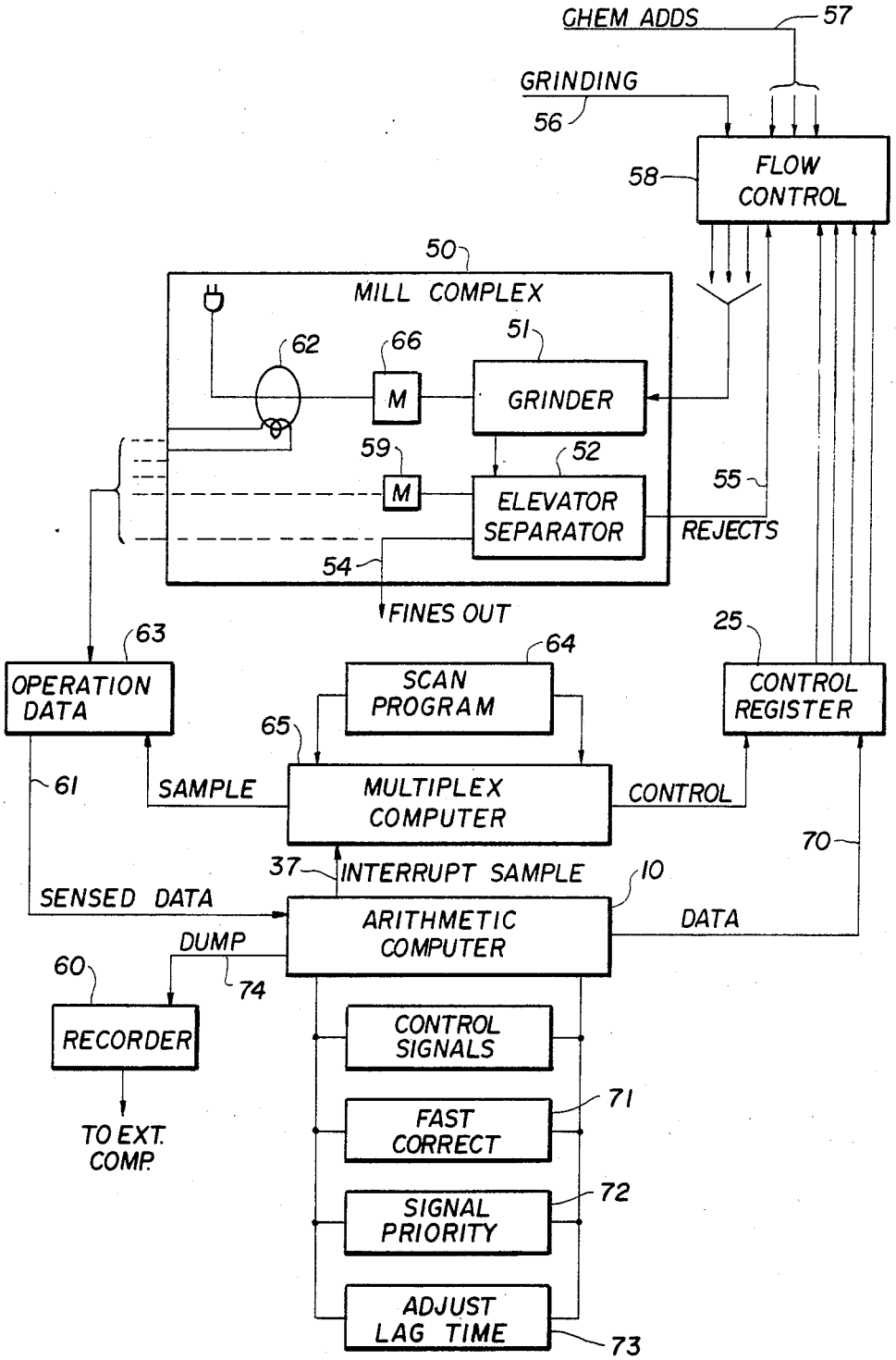
FIG. 2 is a functional block diagram showing the multiplexing/sampling function interrelationship with the arithmetic computer for controlling the feed of various materials into the grinding mill as a function of input mill parameter signals to establish an optimum set position.

In FIG. 2, the block diagram represents the operational interactions of the system hereinbefore described. Thus, the mill complex 50, has a grinder 51 and elevator or fines separator system 52 for producing from the ground product output ground fines 54 and for recycling separator rejects 55 that need further grinding. Newly added clinker materials, etc. to be ground 56, and appropriate chemical additives 57 are processed through flow control means 58 that may be put under influence of the control registers 25 of the computer system. Respective small HP and large HP motors 59 and 66 control the elevator 52 and the grinder 51 and provide two horsepower signals which can be used as the primary control signals by this invention.

Data is sensed in the mill complex suitable for deriving control functions in the arithmetic computer 10, as indicated by line 61. Thus, one useful signal, the horsepower, proportional to the grinding rate or Tons Per Hour passing through the grinder, may be derivable from the grinder motor 66 as a horsepower related reading. The elevator control horsepower signal is specially effected by fluff as explained in other portions of this disclosure, and is used as a second useful signal. These flow related signals are selected at box 63 for input to the computer 10, by operation of the multiplex computer 65, in response to a scan program 64 initiated periodically by a sampling signal 37.

For control purposes it is critical that a large signal swing be derived from the large (2000) horsepower motor 66 for the mill which carries a rather high current flow upon which is superimposed a very small percentage signal fluctuation representative of critical horsepower changes indicating departure from a preferred operating condition. By means of the current transformer 62 electromagnetically coupled to the motor power cord, the entire signal variation range incurred in the grinder motor is captured for use, thereby providing a very large and accurate range of control. The same detection means may be employed for the elevator motor 59, which has a much lower horsepower.

Accordingly, it is clear that the computer 10 may be programmed to calculate from selected and multiplexed input signals from the desired control conditions as derived from sensed conditions within the mill complex. Also it is evident that computed results from arithmetic computer 10 for a plurality of computed control signals can be multiplexed into the output control register 25 to control the flow of materials in accordance with a computed flow formula.

Thus, the computer 10 will in response to an input signal and appropriate program sequences derive a control signal which tends to keep the grinder complex operable with a goal such as high efficiency or maximum throughput, as provided at control lead 70 for retention in control register 25.

In accordance with this invention, not only is a main control computation cycle for establishing a desired mill complex operating condition undertaken, but several auxiliary computer cycles are made available as shown in blocks 71 to 73. The block 71 thus labelled "Fast Correct" serves to increase the magnitude of the correction signal as a function of the deviation of the control from a predetermined setpoint. Block 72 likewise provides a program subroutine for priority selection for correction by that input signal that has the greatest deviation or error from the setpoint. Block 73 provides a subroutine for correction of lag time when the deviation or control error becomes large. The recorder 60 is controlled for dumping into an external computer by way of a dump command control circuit 74.

Figure 3:
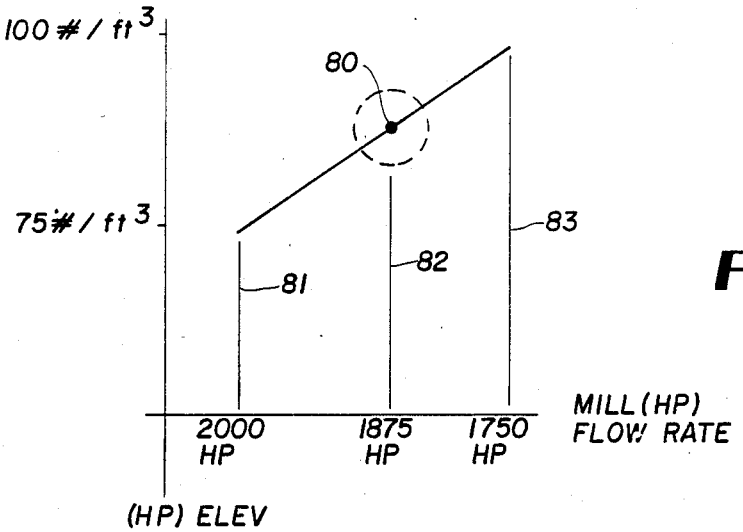
FIG. 3 is a graph illustrating the operational objectives of the present invention in establishing a predetermined setpoint operating condition.

Before going over the details of functional operation, the general operational characteristics of grinding mill complexes need be surveyed. Thus, we should consider the graph of FIG. 3, wherein the abscissa represents a mill signal in terms of material flow rate through the grinder or mill horsepower. This as shown in the parent case is conveniently indicated by the motor current signal. The ordinate represents bulk density of the materials in the grinding flow path in terms such as pounds per cubic feet.

A target operating condition determined to be optimum from empirical mill studies or external computer analysis is shown at 80. In a typical mill complex, the three vertical operating conditions 81, 82, 83 thus will show the range of mill motor horsepower variation encountered over the acceptable range of flow rate in such terms as tons per hour (TPH) or lbs/min/ft$^3$ of voids. In operation with chemical additives to improve grinding efficiency, at midline 82 the chemicals feed rate is typically 0.035% solids on solids (SOS) or, 0.70 pounds per ton of new feed. Note however that a variation of increased or decreased flow will establish a condition where less chemicals should be used. Thus at the end lines 81, 83 the chemical additive is reduced to 0.015% SOS or 0.30#/ton. Target point 80 on line 82 then represents the setpoint or set conditions to which control should be directed by means of the computer arrangement herein described, as variations occur in mill or elevator horsepower.

Accordingly, it may be seen that the sensing of signals representative of (1) the mill horsepower such as the mill motor current, as set forth in the parent application, and (2) the elevator horsepower will indicate a coordinate representative of the actual operational point. Also, from the actual operating point, the difference or error signal showing how great a departure this is from the set or target point 80 becomes known and is readily calculated in computer 10. The main control signal therefore is derived to direct the actual operating point to the target set point 80 by appropriate feed of materials to achieve maximum mill efficiency.

However, a serious problem exists when the elevator bulk density becomes low and fluff builds up. This condition tends to overload the elevator motor (59, FIG. 2).

Accordingly, it is most important to prevent damage and this is done by sensing the mill signal and the elevator overload (bulk density) signal to see which input motor horsepower signal error (overload deviation from setpoint) is largest, and giving correction priority to the largest overload deviation.

Furthermore, to assure rapid correction to the setpoint a nonlinear correction function is used increasing the correction signal as the error (deviation from setpoint) increases. This is also achieved in arithmetic computer 10 by an algorithm relationship later described.

All these calculations are by this invention made dynamically dependent upon any deviation from the setpoint, termed the variable error signal E. Accordingly, the actual new feed rate TPH=the starting new feed rate (intercept point) TPH($\phi$)$\pm$MX, where TPH is tons per hour, M is a constant representing sensitivity of the system—the slope of the curve in FIG. 3,—and $X=PE+[I(E)(T)+\text{Sum } 2]+D(E_i-E_h)/T$, a correction factor. $E_i$ is the instantaneous error deviation and $E_h$ is the historical previous deviation. Sum 2 is the summation of past deviations $\Sigma I(E)T$ (past). Thus, this is a commonly known control equation taking into account an error component, a deviation distance component and a rate of change component. It is modified in accordance with this invention, however, to make the conventional P, I, D constants corresponding to the aforesaid components variably dependent upon the error component E. Thus, the "constants" P, I, and D are all made variably dependent upon the error deviation E as follows:

$$P = 140 + 1300E$$

$$I = \frac{1}{7.2 + 260E}$$

$$D = \frac{1000}{3.6 + 0.13E}$$

P in the formula for X is a proportionally constant;

I is a constant representative of the distance from setpoint, and

D is a constant representative of the rate of correction.

The objective then is to tune the system for the best P, I, D at all times, where the best P, I, D is at the target setpoint (E=O). This is programmed into computer 10. The P, I, D values above set forth are empirically determined.

Also a correction may be made for the lag time it takes to correct or have an effect on the system: L=3.6+1.3E. This then accounts for variations with the error magnitude in the lag time it takes for making the control change effective in the grinding mill by effecting a change of flow of materials.

The correction signal derived as a result of these algorithms makes an adjustment in the flow of materials such as by increasing or decreasing the flow of clinker to be ground or the flow of chemicals into the system. Typically at the setpoint a known desired proportion of additive chemicals will optimize grinding efficiency and cost. Thus, by the multiplex capabilities of this system the several (four) output controls could typically operate to control the flow of new clinker materials, chemical additives, water, etc. at various desired proportions. For example, two critical chemical additives could be added as separate percentages of the clinker control flow rate as calculated in computer 10 and stored in control register 25.

Furthermore, the control loop by means of computer 10 calculation proportionately derives a larger percentage of change of the correction signal as the deviations from setpoint increase by the relationship $$\frac{\Delta P}{\Delta CP} = 0.375 + 3.57E.$$

where $\Delta P$ is the outgoing correction signal variable change in percent and $\Delta CP$ is the incoming sensed actual correction variable in percent.

In summation, the motor horsepower signal tells the flow rate. An error signal is calculated to tell how far off the flow rate is. Then a new feed rate is adjusted to stay on the setpoint (80). This is done by continually computing corrections to the starting feed rate.

Also the system remembers (Sum 2) how much difficulty the system is having to keep the error at a minimum. The system objective is to adjust the new feed rate to keep the set flow rate as nearly constant as feasible.

The programming of these algorithms for control of grinding mills by means of computers is well within the skill of those in the art as may be seen by reference to the status of the background art. Also the programming varies from computer to computer and this invention is adapted for general application using many different types of currently available computers. Thus, this case is not complicated by the detailed outline of program steps for the various arithmetic steps. However, reference to FIG. 4 shows the general flow diagram of system operation with the computer system hereinbefore described.

Figure 4:
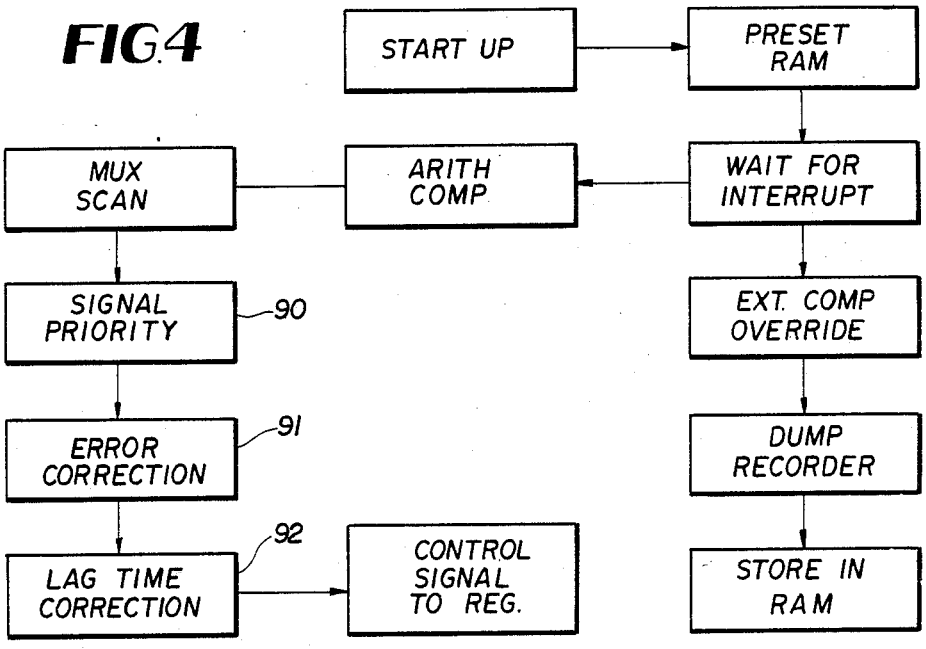
FIG. 4 is a data flow chart in the multiplexing computer.

As seen in FIG. 4, the interrupt command initiates action to either dump the recorder or initiate the multiplex system scan. The dump interrupt can be given preference. Note that in block 90 signal priority is determined before other calculations on the correction signals for updating the control register data. That step of prioritizing is set forth in the flow chart of FIG. 5.

Also as hereinbefore described, the magnitude of the correction signal to be used is non-linearly adjusted in accordance with the magnitude of the error deviation at block 91. That is, the larger the deviation from set position, the larger percentage of correction signal is produced.

Similarly in block 92, the lag time correction to the signal is calculated and effected. Then, the adjusted correction signal is stored in the register 25 as updated from time to time in the sampling procedure.

Figure 5:
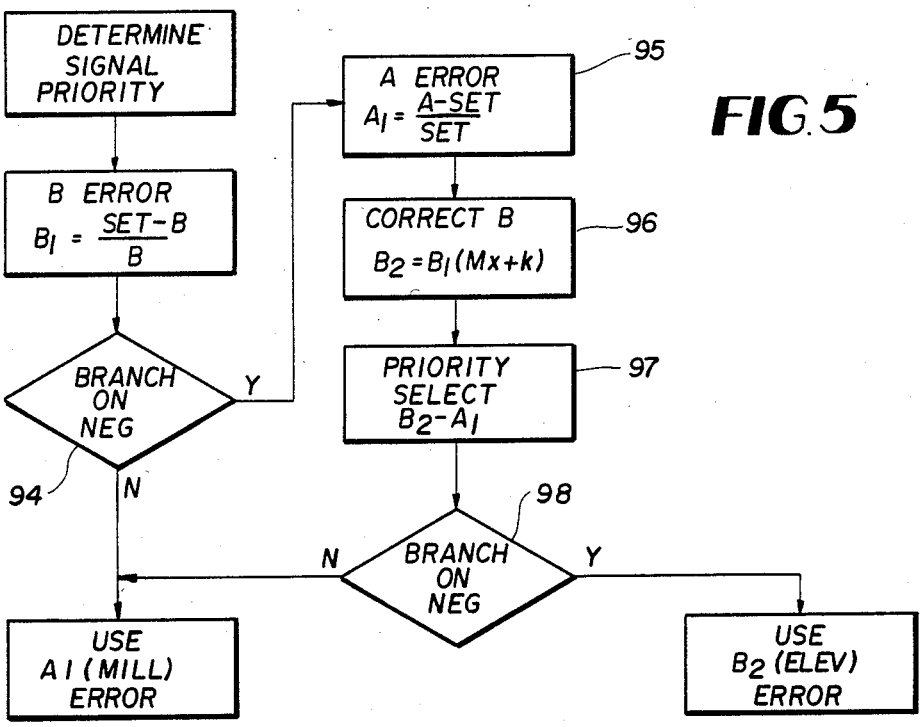
FIG. 5 is a subroutine data flow chart for selecting a preferred one of a plurality of sensed mill operation signals thereby to effect both more rapidly the setpoint operating characteristic and to prevent equipment damage.

Consider the subroutine of FIG. 5. As beforesaid, either increased fluff or increased tonnage may endanger the elevator motor. The signal input indicative of a low bulk density termed the elevator signal (B) thus is investigated to determine the error magnitude $B_1$ away from a chosen setpoint. If the B signal is greater than the setpoint where density is high then the new $A_1$ error signal is selected by branching block 94. If the density is low (fluffy system) then the new Mill current error $A_1$ is calculated at 95 and compared with a corrected B error $B_2$ at 96. Note that this is done by means of the general calculation formula used to derive the correction signal in the arithmetic computer 10. The form of this signal MX+k is such that M is the shape of the correction factor curve and k is the intercept point, and this is the control function explained in more detaile hereinbefore.

In blocks 97, 98 the signal with the greatest deviation from the setpoint is selected as the current correction vehicle.

In cement plants excessive powder causes fluff problems, which are not easy to control, particularly with the interaction of chemicals for improvement of grinding efficiency. If less powerful chemicals are used to avoid fluff, the cost is substantially increased and grinding results may become marginal. With the present invention, however, fluff control is effected while more effective chemicals are in use.

If the mill horsepower is higher than the setpoint, it generally indicates a light flow rate and new feed should be added. However, if fluff presents a problem, the elevator load is high. Thus, to protect the elevator motor and to prevent over addition of the chemicals, the feed is cut back when the elevator load is higher than the set point.

If the mill horsepower is lower than the setpoint, and the feed rate is being reduced to protect the mill motor, it is reduced even more if the elevator motor is more overloaded than the mill motor. (This is not a situation where fluff is generally encountered.)

The following exemplary table shows a set of logical control decisions for this mode of operation.

| | For Setpoint 204 | |
|---|---|---|
| Mill | Elev. | Error Signal Used |
| 208 | 208 | $B_2$ |
| | 204 | $A_1$ |
| | 200 | $A_1$ |
| 204 | 208 | $B_2$ |
| | 204 | $A_1$ |
| | 200 | $A_1$ |
| 200 | 210 | $B_2$ |
| | 208 | $A_1$ |
| | 204 | $A_1$ |
| | 200 | $A_1$ |

It is therefore evident that this invention has improved the state of the art by providing novel controls for improving grinding mill operational performance, and thus the features of novelty believed descriptive of the spirit and nature of this invention are defined with particularity in the appended claims.

We claim:

1. In a digital computer system for control of operating conditions in a grinding mill complex to conform to a predetermined grinding objective setpoint, the improvement comprising, an arithmetic computer programmed to arithmetically derive an output control signal to meet said predetermined grinding objective by control of the input feed of a material that affects the grinding mill complex output product as a function of the magnitude of a sensed input signal indicative of a mill complex operating parameter related to the actual flow of that material, means for providing a plurality of input signals representative of different mill complex operating data sensed relating to different functions of the flow of feed materials, a plurality of control registers each for providing a respective output control signal effective to control the flow of materials through said complex, which signals are derived from said computer, a multiplexing computer programmed to sample and sequence said plurality of input signals into said arithmetic computer for derivation of at least one output control signal and to sequence into said corresponding plurality of control registers a control signal calculated by said arithmetic computer, whereby the system controls the feed and flow of materials in the grinding mill complex operations in response to the control signals derived from said sensed input signals.

2. The system defined in claim 1 wherein the arithmetic computer program provides as said predetermined grinding objective conformance of the flow of feed materials into the mill complex to maintain the flow of materials through the mill complex at a predetermined set value.

3. The system defined in claim 2 wherein the arithmetic computer provides as an output control signal a correction signal for returning the flow of materials through the mill complex to said set value, which correction signal varies as a nonlinear function of the input flow signal producing a larger percentage change of output signal with respect to the percentage change of the corresponding input signal as deviation magnitude from the set value increases.

4. The system defined in claim 3 wherein the arithmetic computer provides an additional output signal modification to correct for system lag time, and the lag time correction signal is varied to derive a larger lag time correction as the deviation magnitude from the set value increases.

5. The system defined in claim 1 wherein said computer is programmed to achieve the predetermined grinding objective of correcting any deviation of the mill complex data sensed by the plurality of input signals from a respective corresponding predetermined set value, including priority control means for determining which of said plurality of signals has the greatest deviation magnitude from the set value and deriving an updated control signal in the register for that signal before derivation of updated control signals for the signals with lesser deviation magnitudes.

6. The system defined in claim 1 wherein said mill complex includes both mill and elevator motors and means measuring the horsepower thereof with said plurality of inputs signals comprising the two horsepower signals, one indicating mill horsepower, and the other indicating the elevator horsepower, and said control signals function to control the system feed of new grinding materials and grinding aid chemicals as a function of the mill horsepower and the elevator horsepower for establishing a predetermined target feed rate.

7. The system defined in claim 6 wherein the flow of grinding aid chemicals is controlled as a predetermined proportion of grinding aid chemicals to the flow of new materials being ground in response to the mill horesepower.

8. The system of claim 6 wherein the departure of the grinding conditions from said target is termed an error signal, and the flow of materials is controlled to reduce the error signal (E).

9. The system of claim 8 wherein a correction signal for the flow of grinding materials is calculated as a function of a P, I, D loop correction function wherein the P, I and D factors are made variably dependent upon the error signal E.

10. The system of claim 9 wherein the P factor is approximately $P=140+1300E$.

11. The system of claim 9 wherein the I factor is inversely proportional to approximately 7.2+260E.

12. The system of claim 9 wherein the D factor is inversely proportional to approximately 1000/3.6+0.13E.

13. The system of claim 8 wherein the signal for control of flow of materials to return to said target is a variable function of the error signal E which increases nonlinearly the magnitude of the flow control signal as E grows larger.

14. The system of claim 13 wherein the control signal variable function is such that the ratio of the outgoing variable change in percent to the incoming variable change in percent of two spaced samples is equal to approximately 0.375+3.57E.

15. The system of claim 1 including interface means controlled by said multiplexing computer for transferring system operating data to an external computer.

16. The system of claim 1 including means for controlling the flow of chemical grinding aid additives in response to control signals in said control registers.

17. The system of claim 16 wherein the control of the flow of chemical grinding aid additives provides a maximized flow magnitude at said setpoint and a lesser flow magnitude responsive to both increase or decrease of flow of materials through said mill.

18. In a digital computer system for control of grinding mill complex operations, the improvement comprising, means for providing a plurality of input signals representative of mill operating conditions, sampling means responsive to the instantaneous magnitude of said input signals, arithmetic calculating means in the computer system for deriving from time to time from the sampled input signals corresponding control signals for control of mill operation, means for control of the grinding mill complex operating conditions to establish a desired operating set condition, means selecting from the respective sampled instantaneous input signals a highest priority input signal deviating the greatest magnitude from the operating set condition, sampling priority means establishing a correction control function dependent upon that selected signal which has the greatest overload deviation from the desired operating condition, and correction means deriving from said arithmetic calculating means a prioritized correction control signal for correction of mill complex operations toward said set condition.

19. In a digital computer system for control of grinding mill operations the improvement comprising, a sensor providing a signal representative of a mill grinding condition, a computer programmed to arithmetically derive from said signal an error signal representative of the deviation of the sensed signal from a predetermined operating condition, a control register providing a correction control signal for establishing the grinding mill operations at said predetermined operating condition responsive to said error signal, and nonlinear correction means increasing the proportionate magnitude of the correction control signal as the error signal becomes larger, thereby to obtain a larger percentage change of the correction signal as the magnitude of the error signal increases.

20. The improvement defined in claim 19 including means operable with the nonlinear correction means to increase the proportionate magnitude of the correction signal in accordance with approximately the function $$\frac{\Delta P}{\Delta CP} = 0.375 + 3.75E$$

where ΔP is the % change of the outgoing variable, ΔCP is the % change of the incoming variable, and E is the error deviation of the incoming signal from the desired operating condition.

* * * * *